US010987688B2

(12) United States Patent
Dupont et al.

(10) Patent No.: US 10,987,688 B2
(45) Date of Patent: Apr. 27, 2021

(54) PACKAGING DEVICE FOR A PRODUCT TO BE DISPENSED

(71) Applicant: Louis Vuitton Malletier, Paris (FR)

(72) Inventors: Celine Dupont, Colombes (FR); Aurelie Seurat, Levallois-Perret (FR); Benedicte Gory, Paris (FR); Dephine Billebeau, Bezons (FR)

(73) Assignee: Louis Vuitton Malletier, Paris (FR)

( * ) Notice: Subject to any disclaimer, the term of this patent is extended or adjusted under 35 U.S.C. 154(b) by 0 days.

(21) Appl. No.: 15/502,404

(22) PCT Filed: Aug. 4, 2015

(86) PCT No.: PCT/FR2015/052158

§ 371 (c)(1),
(2) Date: Feb. 7, 2017

(87) PCT Pub. No.: WO2016/020620

PCT Pub. Date: Feb. 11, 2016

(65) Prior Publication Data

US 2017/0232459 A1 Aug. 17, 2017

(30) Foreign Application Priority Data

Aug. 8, 2014 (FR) ..... 1457714

(51) Int. Cl.

| | |
|---|---|
| ***B05B 11/00*** | (2006.01) |
| ***A45D 34/02*** | (2006.01) |
| ***B65D 1/02*** | (2006.01) |
| ***B65D 25/20*** | (2006.01) |

(Continued)

(52) U.S. Cl.

CPC ..... *B05B 11/3043* (2013.01); *A45D 34/02* (2013.01); *B05B 11/0008* (2013.01); *B05B 11/0037* (2013.01); *B65D 1/023* (2013.01); *B65D 1/0207* (2013.01); *B65D 25/205* (2013.01); *B65D 25/54* (2013.01); *A45D 2034/007* (2013.01)

(58) Field of Classification Search

CPC ..... B05B 11/3043; B05B 11/0008; B05B 11/003; B05B 11/0037; A45D 34/02; A45D 2034/007; B65D 25/205; B65D 25/54; B65D 1/0207; B65D 1/023

USPC ..... 222/383.1, 153.09, 153.114, 182, 222/382–385; 215/14–31

See application file for complete search history.

(56) References Cited

U.S. PATENT DOCUMENTS 626,417 A * 6/1899 Freese ..... 222/147
929,356 A * 7/1909 Westerlund ..... 215/21

(Continued)

FOREIGN PATENT DOCUMENTS

FR 2719292 A1 11/1995
FR 29955091 A1 7/2011

OTHER PUBLICATIONS

International Search Report for corresponding PCT Application No. PCT/FR2015/052158; report dated Nov. 13, 2015.

*Primary Examiner* — Lien M Ngo
(74) *Attorney, Agent, or Firm* — von Briesen & Roper, s.c.

(57) ABSTRACT

The invention relates to a packaging device comprising a bottle containing a product to be distributed and having a neck, and a dispensing device comprising a body arranged in the neck. A cache masking the body of the dispensing device is arranged in the neck of the bottle.

12 Claims, 7 Drawing Sheets

(51) Int. Cl.
*B65D 25/54* (2006.01)
*A45D 34/00* (2006.01)

(56) References Cited

U.S. PATENT DOCUMENTS

| | | | | | |
|---|---|---|---|---|---|
| 2,232,129 | A * | 2/1941 | Nelson | B65D 49/04 | 215/21 |
| 4,154,369 | A * | 5/1979 | Morane | B05B 11/3047 | 222/147 |
| 4,351,451 | A * | 9/1982 | Chung | A47J 41/028 | 215/12.1 |
| 5,845,819 | A | 12/1998 | de Pous | | |
| 6,189,741 | B1 * | 2/2001 | Behar | B05B 11/0013 | 222/321.7 |
| 6,279,786 | B1 * | 8/2001 | de Pous | B05B 11/0013 | 222/321.9 |
| 8,286,838 | B2 * | 10/2012 | Preteroti | A45D 34/04 | 222/321.9 |
| 8,955,717 | B2 * | 2/2015 | Kellogg | B65D 49/04 | 222/147 |
| 10,149,527 | B2 * | 12/2018 | Thorez | A45D 34/02 | |
| 2008/0237268 | A1 * | 10/2008 | Preteroti | A45D 34/04 | 222/321.9 |
| 2014/0034679 | A1 * | 2/2014 | Fitzpatrick | A47K 5/16 | 222/190 |
| 2015/0014361 | A1 * | 1/2015 | Platel | B65D 83/206 | 222/321.8 |
| 2015/0166253 | A1 * | 6/2015 | Nomura | B65B 31/003 | 222/402.1 |

* cited by examiner

PACKAGING DEVICE FOR A PRODUCT TO BE DISPENSED

CROSS-REFERENCE TO RELATED APPLICATION

This Application is a 35 USC § 371 US National Stage filing of International Application No. PCT/FR2015/052158 filed on Aug. 4, 2015, and claims priority under the Paris Convention to French Patent Application No. 14 57714 filed on Aug. 8, 2014.

FIELD OF THE DISCLOSURE

The invention relates to packaging devices for a product to be dispensed.

BACKGROUND OF THE DISCLOSURE

Such packaging devices for a product to be dispensed are known, comprising:

- a bottle suitable for containing the product to be dispensed and having a neck delimiting an opening,
- a dispensing device comprising a body arranged in the neck and suitable for dispensing said product, and
- a cover masking the body of the dispensing device.

In such packaging devices, the cover is accessible: it can therefore be soiled by product residue or damaged, in particular scratched.

One particular aim of the invention is to overcome this disadvantage.

SUMMARY OF THE DISCLOSURE

To this end, it proposes a packaging device for a product to be dispensed, comprising:

- a bottle suitable for containing the product to be dispensed and having a neck delimiting an opening,
- a dispensing device comprising a body arranged in the neck and suitable for dispensing said product,
- a cover masking the body of the dispensing device.

The device is noteworthy in that said cover is located in the neck of said bottle. The cover is thus protected by the neck and can no longer be soiled, damaged, or scratched.

In various embodiments of the packaging device according to the invention, it is also possible to make use of one or more of the following arrangements:

- the cover is fixed at least partially to an inner wall of the neck;
- the neck is formed integrally with the bottle;
- or the neck is attached to the bottle;
- a washer-like seal is coaxially positioned at least partially inside the neck, against one end of the cover;
- the seal is positioned between the cover and the inner wall of the neck;
- a washer-like seal is positioned between the cover and the bottle;
- in the case where the neck is attached, the device comprises a second neck formed integrally with said bottle, said dispensing device being at least partially fixed in said second neck and said attached neck surrounding said second neck;
- the cover comprises two cylindrical coaxial elements respectively having an internal thread and an external thread, the internal thread and the external thread engaging to enable screwing the two elements together, one of the elements of the cover being fixed around the second neck and the other element of the cover being fixed inside the attached neck;
- the cover comprises a material fluidtight to said product;
- the cover is made of tinted plastic, of metal-covered plastic, of decorated or textured metal, or any other material such as cork for example;
- the neck has an internal shoulder at a free end and the cover has an end forming an elbow suitable for bearing against said internal shoulder of said neck;
- the neck forms an internal shoulder with an upper end of the bottle;
- the bottle is made of glass;
- the bottle is made of transparent or translucent material.

The invention also relates to a method for producing the packaging device as defined above, wherein the cover is fixed to any of the parts of the packaging device by bonding with ultraviolet radiation, hot-melt adhesion, remelting glass, bonding with enamel, by high pulsed power, or bonding two adhesive metallized plates, one of the two plates being previously bonded to the bottle and the other plate being previously bonded to the neck.

In the invention, the neck of the packaging device may be attached to the bottle by being fixed to the packaging device by bonding with ultraviolet radiation, hot-melt adhesion, remelting glass, bonding with enamel, by high pulsed power, or bonding two adhesive metallized plates, one of the two plates being previously bonded to the glass bottle and the other plate being previously bonded to the neck. Advantageously, a glass bottle is used.

Other features and advantages of the invention will become apparent from the following description of one of its embodiments, given by way of non-limiting example, with reference to the accompanying drawings.

DETAILED DESCRIPTION OF THE DISCLOSURE

In the following description, the terms "lower", "upper", "bottom", "top", etc. are used in reference to the drawings for greater ease of understanding. They should not be construed as limitations to the scope of the invention.

In addition, references designating the same elements have been maintained from one figure to another to facilitate viewing, even when these elements may have different shapes.

Figure 1:
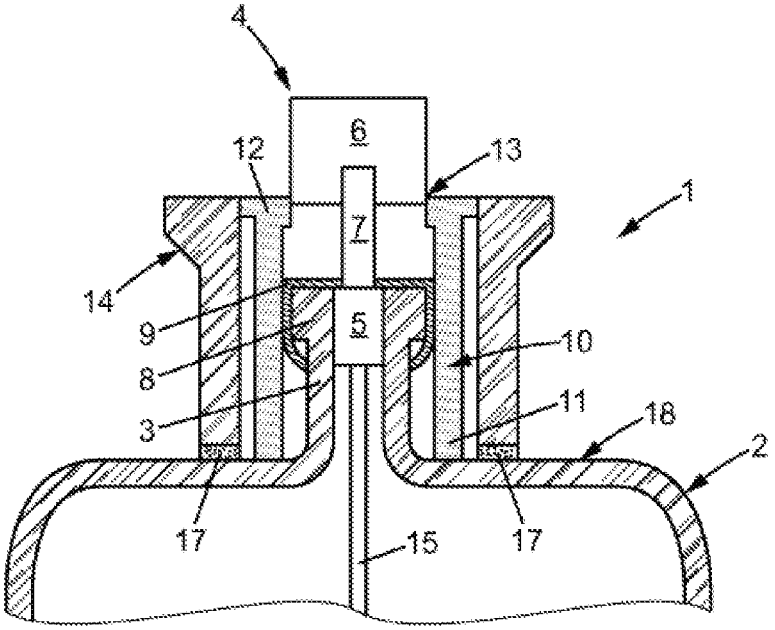
FIG. 1 is a partial and schematic cross-sectional view of a packaging device according to a first embodiment of the invention.

FIG. 1 shows a first exemplary embodiment of a packaging device 1 according to the invention.

The packaging device 1 comprises a transparent or translucent bottle 2 made of glass and formed of a glass body defining a reservoir suitable for containing a fluid or liquid product such as perfume, for example. The bottle could also be made of another material such as plastic or Surlyn®.

According to a first embodiment, the packaging device 1 comprises a neck 14 attached to the glass bottle 2.

The attached neck 14 is a sleeve made of glass using any known technique, for example by molding or blowing a bottle and cutting off its neck.

The sleeve may have any cross-sectional shape: square, circular, ovoid, etc. The sleeve has a wider end, forming a decorative flange, intended to be oriented upwards on the dispensing device 1.

The sleeve could be made of another material, for example Surlyn® or any other transparent material.

The glass body forming the bottle 1 is surmounted by a second neck 3 also made of glass, integrally formed with the bottle 2, which delimits an opening through which the bottle can be filled with said product to be dispensed.

The attached neck 14 and the second neck 3 are coaxial.

The glass second neck 3 at least partially encloses a dispensing device 4.

In particular, the dispensing device 4 may be a manual pump suitable for spraying or simply dispensing a dose of product at each actuation.

The dispensing device thus comprises a body 5, commonly referred to as a "pump body", connected to a coaxial pushbutton 6.

The body 5 is directly or indirectly fixed in the second neck 3, and the pushbutton 6 protrudes above the neck. In the usual manner, the pushbutton 6 is mounted at the free end of a tube 7, also called a rod or stem, mounted so as to slide axially in the body 5 and actuate a piston (not shown) contained in the body 5 of the pump, in a manner known per se.

Finally, the dispensing device comprises a dip tube 15 for withdrawing product from the bottle 2 and feeding product to the body 5.

The second neck 3 of the bottle comprises a bead 8 at its free end forming the mouth of the bottle 1, onto which is crimped a ring 9, sometimes called a cap or capsule, ensuring the attachment of the dispensing device 4.

In order to achieve an aesthetic assembly, a cover 10 is fitted around the assembly composed of the second neck 3 equipped with the dispensing device 4. The cover is in the form of a cap comprising an end 12 having a through-opening 13 to provide passage for the pushbutton 6, as well as a lateral skirt 11 integral with the end 12.

In another embodiment, the cover could protrude beyond the neck and present, for example, a fluted edge to allow snap-fitting a cap.

The cover 10 is fixed to the dispensing device or to the crimping ring or to a portion of the bottle 1, by any known means.

The attached neck 14 is substantially of the same height as the cover 10, to protect the cover 10 along its entire height while allowing access to the protruding pushbutton 6.

Such a packaging device is made in the following manner: firstly, the glass bottle 2 and the second neck 3 are produced by blow-molding.

The attached neck 14 is made independently, for example of machined pressed glass, of injected plastic, or by cutting off the neck of a bottle made of blown glass.

The attached neck 14 is then fitted around the neck 3 of the glass bottle 2 and is fixed to the surface of the upper portion 18 of the glass bottle, near the neck 3 of the glass bottle. In the context of this embodiment, the attached neck 14 is fixed to the bottle for example by bonding 17 with ultraviolet radiation, hot-melt adhesion, remelting glass, bonding with enamel, or bonding two adhesive metallized plates, one of the two plates being previously bonded to the glass bottle and the other plate being previously bonded to the neck.

The glass bottle 2 is then filled with product.

Finally, the dispensing device 4 is fixed in the neck 3 of the glass bottle 2 and the cover 10 is inserted between the two necks 3 and 14, around the dispensing device 4.

In the context of this example, the attached neck 14 is not fixed to the cover 10 and an annular clearance can be left between the attached neck 14 and the cover 10.

The clearance left between the neck 14 and the cover 10 eliminates a magnifying optical effect. In this case, the cover 10 could also include a widened portion at the top for aesthetic reasons as well as to prevent dust from entering the space.

Figure 2:
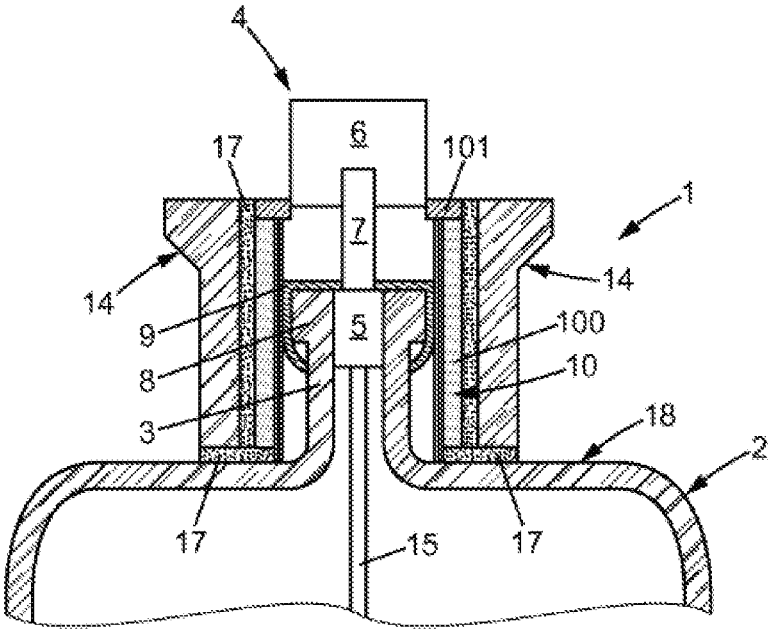
FIG. 2 is a partial and schematic cross-sectional view of a packaging device according to a second embodiment of the invention.

FIG. 2 shows another example of a dispenser according to the invention.

The glass bottle 2, its neck 3, the attached neck 14, and the dispensing device 4 as a whole are identical to those shown in FIG. 1.

The difference lies in the cover 10, which is made of two parts 100 and 101, preferably of plastic.

The first part of the cover 10 is a tube of circular cross-section 100 which is bonded (bonding layer labeled with reference 17) inside the attached neck 14.

It should be understood that the tube of circular cross-section 100 could be press-fitted into the attached neck and held by clamping force. In addition, the tube may be decorated on the outside, for example by metallizing, lacquering, etc.

The second part of the cover 10 is a washer 101 having a through-opening in its center of a diameter slightly greater than that of the pushbutton 6 to enable insertion of the pushbutton into the through-opening.

Such a packaging device 1 is made as follows: the glass bottle 2 and its neck 3 are made beforehand by blow-molding, as in the context of the embodiment shown in FIG. 1.

The attached neck 14 is made separately, as in the example illustrated in FIG. 1.

Part 100 of the cover 10 is then fixed inside the attached neck 14 by bonding with ultraviolet radiation (the bonding layer is denoted 17 in FIG. 2).

The bottle 1 is then filled with product.

Next, the dispensing device 4 is fixed to the glass neck 3 of the bottle 2.

Finally, the attached neck 14 is fixed to the upper portion 18 of the glass bottle 2 and the washer 101 of the cover is placed and fixed on the end of the tubular part 100 of the cover, in the attached neck 14.

Figure 3:
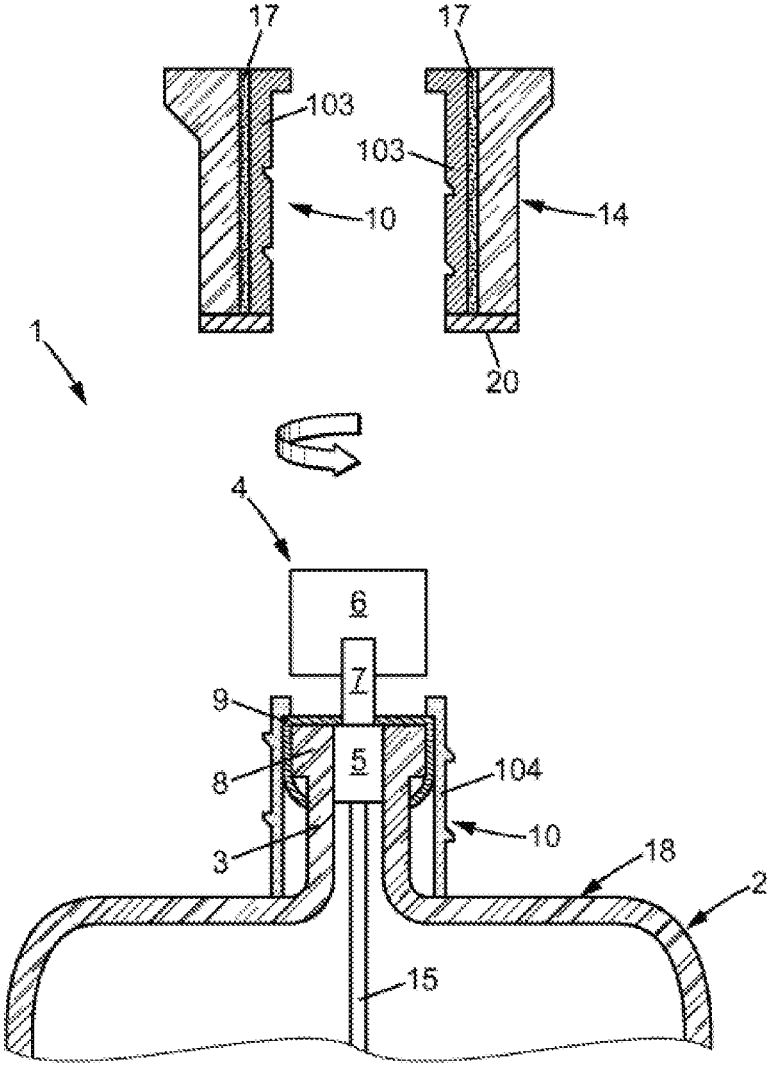
FIG. 3 is a partial, exploded, schematic cross-sectional view of a packaging device according to a third embodiment of the invention.
Figure 4:
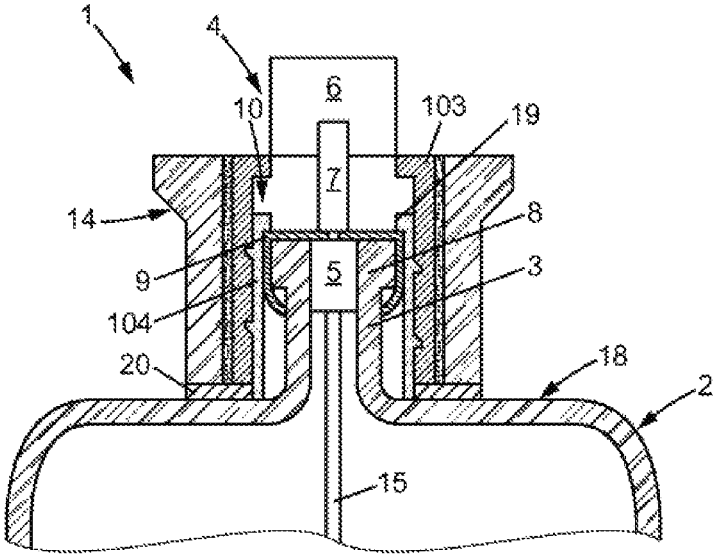
FIG. 4 is another partial and schematic cross-sectional view of the packaging device shown in FIG. 3.

FIGS. 3 and 4 show yet another variant embodiment of the packaging device 1 according to the invention, comprising an attached neck 14.

In this example, the glass bottle 2, its neck 3, the attached neck 14, and the dispensing device 4 as an assembly are identical to those shown in FIG. 1 or 2.

In this case, the cover 10 comprises two elements 103 and 104.

The elements 103 and 104 of the cover 10 are tubular and each have a thread, respectively internal and external. The elements 103 and 104 are made of plastic. Element 103 may be decorated or metal-covered, and the element may also be decorated.

In the context of this example, the glass bottle 2 and its neck 3 are made beforehand by blow-molding, and the attached neck 14 is made separately, as already described for the examples shown in FIGS. 1 and 2.

Part 103 of the cover 10, which has the internal thread, is fixed inside the attached neck 14 by bonding with ultraviolet radiation 17.

The attachment of part 103 along all or a portion of the interior of the attached neck 14 is done so as to maintain a clearance intended to prevent a magnifying optical effect. It should be noted that part 103 should have a top lip directed towards the inside of the neck, to hide the clearance between the cover and the pushbutton.

It should also be noted that the attached neck 14 may also be decorated on its inside face, before the bonding of part 103 of the cover, in order to hide the bonding and the technical assemblies.

The glass bottle 2 is then filled with product.

The dispensing device 4 is fixed to the neck 3 of the bottle 2, hermetically sealing it closed.

In the context of this example, part 104 of the cover 10 has an end 19 pierced with a hole in its center of a diameter slightly greater than that of the pushbutton 6 to enable insertion of the pushbutton into the hole.

In one variant, the hole is dimensioned to provide passage for the tube 7 of the dispensing device 4. Thus, during assembly, the pushbutton 6 is removed in order to position part 104 of the cover 10, inserting the tube 7 into the hole through the end 19 of part 104 of the cover.

The pushbutton is then replaced on the tube 7.

This step of positioning part 104 of the cover may take place before or after attachment of the dispensing device to the glass neck 3 of the bottle 2.

Once the dispensing device 4, equipped with part 104 of the cover 10, is fixed to the neck 3 of the bottle, the attached neck 14 is screwed onto part 104 of the cover 10.

A pad 20 in the form of a washer is positioned between the attached neck 14 and the upper portion 18 of the glass bottle 2 in order to cushion any glass/glass contact and compensate for glass tolerances. FIG. 4 shows the dispensing device 1 after assembly.

The pad 20 could also be glued to, overmolded onto, or molded with part 103 of the cover.

Figure 5:
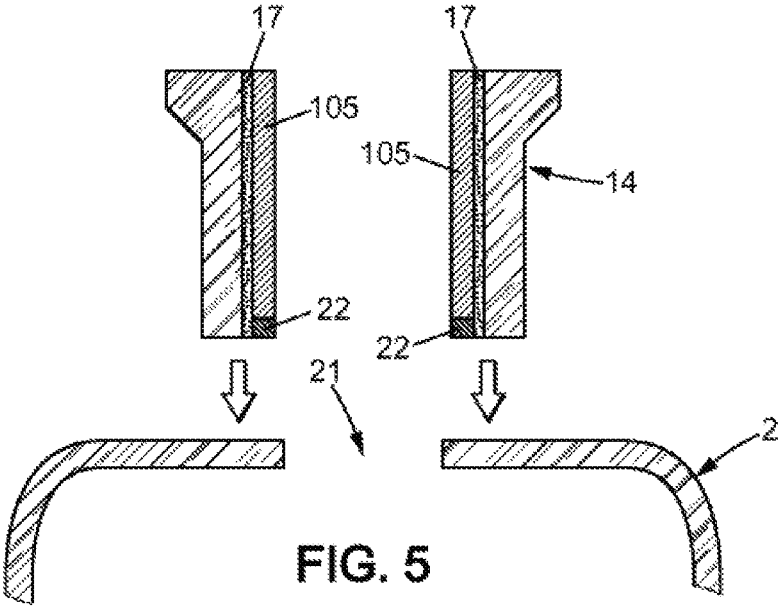
FIG. 5 is a schematic cross-sectional view of a neck of a packaging device, partially represented, according to a fourth embodiment of the invention.
Figure 6:
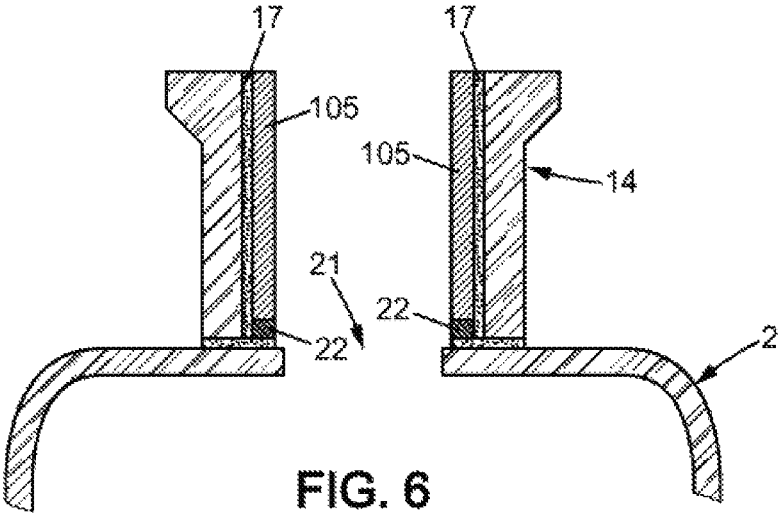
FIG. 6 is another schematic cross-sectional view of the neck of the packaging device shown in FIG. 5.

Other embodiments in accordance with the invention may also be envisaged for the implementation of an attached neck 14, such as those shown in FIGS. 5 and 6.

FIG. 5 shows an attached neck 14 made beforehand, independently of the glass bottle 2.

One will note that the bottle 2 does not comprise a neck 3, but an opening 21 allowing the introduction of product into the bottle 2.

The reckless bottle 2 may be obtained as follows: a glass bottle 2 is produced in a conventional manner, with a glass neck. The glass neck is then cut off to obtain the bottle 2 shown in FIG. 5.

A functional cover 105, capable of accommodating a dispensing device 14 and of sealing the assembly, is fixed inside the glass attached neck 14.

It is fixed by bonding 17 with ultraviolet radiation or by any other bonding means, or else by press-fitting into the neck.

The cover 105 may be made of plastic, of metal, and may be decorated, textured, metallized, etc.

Inside the attached neck 14, at the end of the cover 105, provision is made for placement of an annular seal 22 which is, for example, attached to, bi-injected with, or overmolded to the cover 105.

As seen in the preceding examples, the attached neck 14 created in this manner is assembled onto the upper portion 18 of the bottle 2, around the opening 21, by bonding with ultraviolet radiation, hot-melt adhesion, remelting glass, bonding with enamel, bonding with fusion of two adhesive metallized plates previously bonded to each glass part, etc. FIG. 6 shows the glass bottle 2/attached neck 14 ensemble after assembly.

The examples just described all relate to embodiments in which the neck of the dispensing device according to the invention is attached to the glass bottle 2, the cover 10 being positioned inside said neck.

We will now describe FIGS. 7 to 12, which relate to embodiments in which the glass bottle does not have an attached neck 14.

In FIGS. 7 to 12, the glass bottle 2 comprises an integral neck 23 forming an opening in the bottle.

The neck 23 may have at least one internal shoulder to allow functional assembly of the cover 10, the cover 10 being a specific cover as will be seen hereinafter.

The internal shoulder may be near the opening of the neck 23 (see reference 24 in FIGS. 7, 9, 11, and 12). It is also possible for it to be at the bottom of the neck 23, where the neck 23 meets the upper portion 18 of the glass bottle 2 (see reference 25 in FIGS. 8, 10, and 11).

To create the shoulder 25, it is sufficient to provide a neck 23 with a wall of smaller width.

The cover 10, intended to be positioned in a neck 23 having a shoulder near its free end, is tubular in shape and comprises an end 26 forming an elbow directed radially outward from the cover 10 (FIGS. 7, 9, 11, and 12). The elbow end 26 is designed to be inserted into the shoulder 24 as can be seen in FIGS. 7, 9, 11, and 12.

The elbow end 26 may itself comprise a shoulder 27 directed towards the neck 23 (therefore towards the shoulder 24 of the neck 23), so that when the elbow end 26 is positioned in the shoulder 24 of the neck 23, there is an annular empty space between the elbow end 26 and the shoulder 24 of the glass neck 23.

Figure 7:
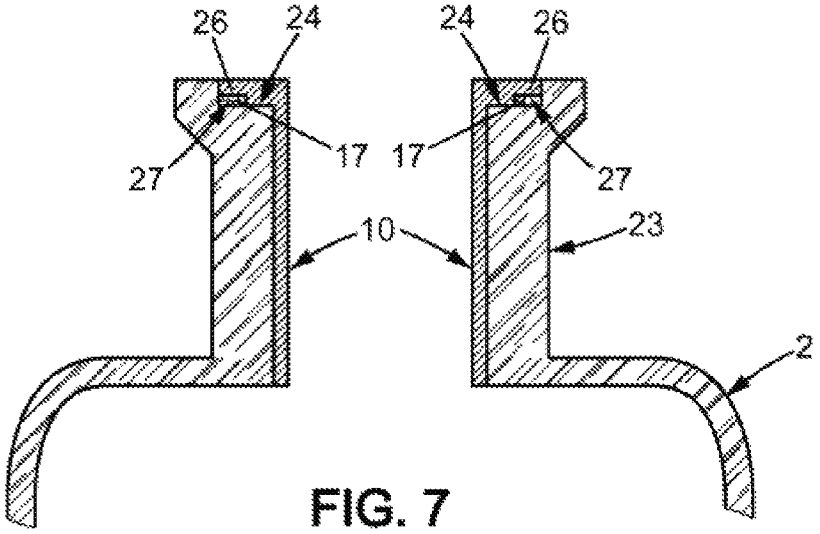
FIG. 7 is a schematic cross-sectional view of a neck of a packaging device, partially represented, according to a fifth embodiment of the invention.

This empty space can be filled with glue 17 or with any other material securing the cover 10 in the neck 23 (see FIG. 7).

Figure 9:
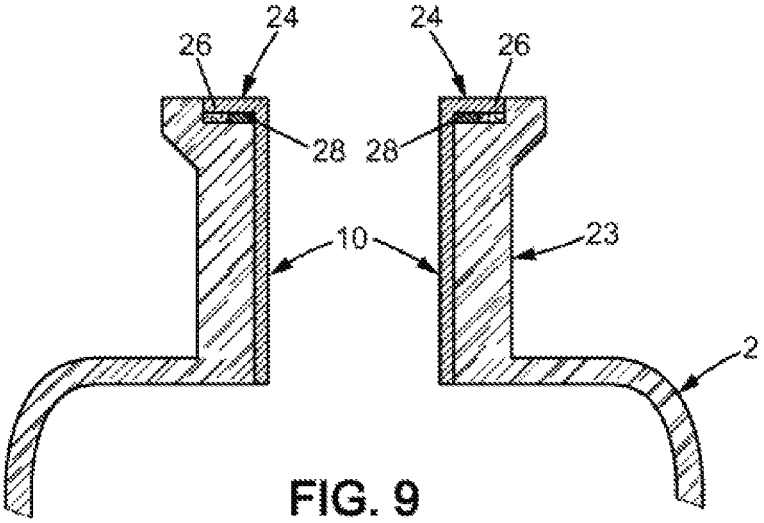
FIG. 9 is a schematic cross-sectional view of a neck of a packaging device, partially represented, according to a seventh embodiment of the invention.

To create this empty space, it is also possible to position a flat annular seal 28 in the shoulder 24, the width of the seal being less than the width of the shoulder 24 (see FIG. 9).

Figure 11:
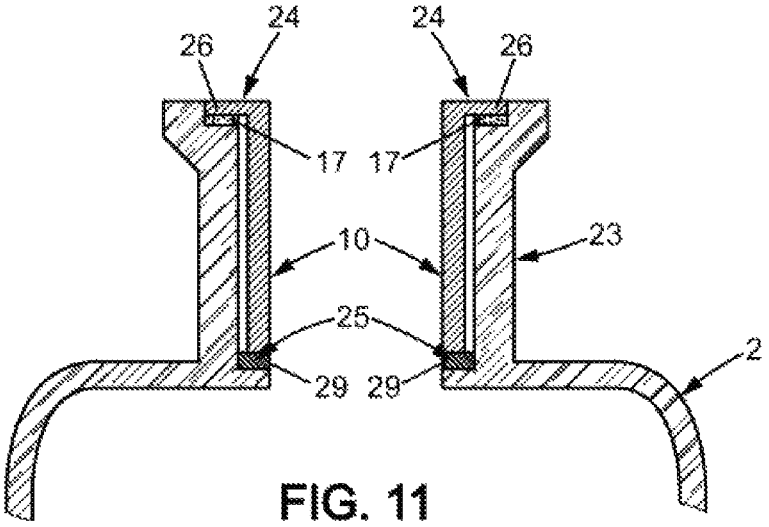
FIG. 11 is a schematic cross-sectional view of a neck of a packaging device, partially represented, according to a ninth embodiment of the invention.

In the case of a neck 23 having a double internal shoulder 24 and 25 (FIG. 11), another flat annular seal 29 may be positioned at the bottom of the lower internal shoulder 25, and the non-elbowed end of the cover 10 is positioned on this annular seal 29.—Another system could be provided, however, if it ensures fluidtightness for the product contained in the bottle (for example of plastic overmolded on the cover 10, the plastic serving as a seal). By reducing the thickness of the elbow portion 26 or by increasing the depth of the upper shoulder 24, an empty space can be created between the elbow end 26 of the cover 10 and the bottom of shoulder 24. As shown in FIG. 11, this empty space may be filled with glue 17.

Figure 12:
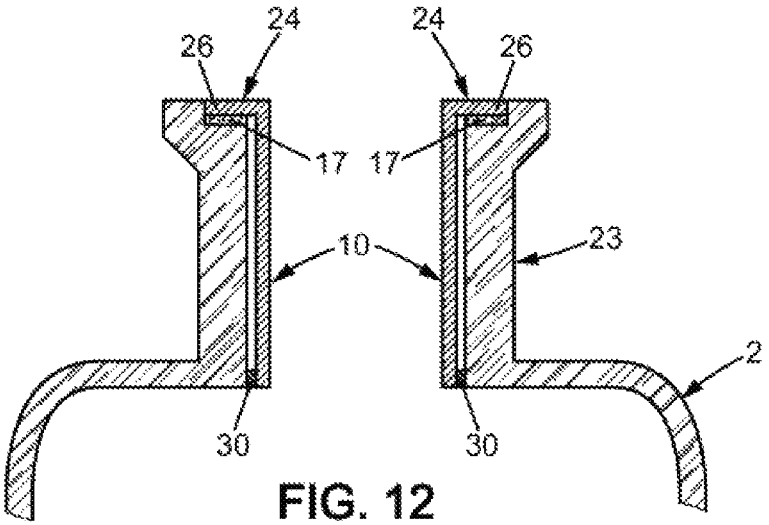
FIG. 12 is a schematic cross-sectional view of a neck of a packaging device, partially represented, according to a tenth embodiment of the invention.

It is also possible, as illustrated in FIG. 12, to provide a cover 10 of a sufficient height to cover the entire length of the neck 23, and to provide a thin elbow portion 26 to leave an empty space between the elbow portion 26 and the bottom of the shoulder 24.

In this example, a second empty space is created between the cover 10 and the glass neck 23 by positioning a seal 30 between the inner surface of the neck 23 and the outer surface of the cover 10, The seal 30 (or sealing system) positioned, as shown in FIG. 12, at the non-elbowed end of the cover 10.

Figure 10:
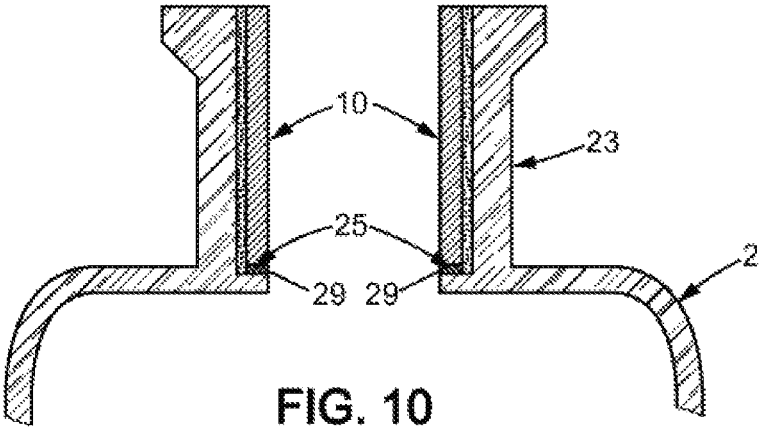
FIG. 10 is a schematic cross-sectional view of a neck of a packaging device, partially represented, according to an eighth embodiment of the invention.

FIG. 10 shows yet another embodiment, in which an annular seal 29 is positioned at the bottom of the lower shoulder 25. The thickness of the seal 29 is substantially the same as that of the cover 10 so that when the cover is positioned above the seal 29, the internal surfaces of the seal 29 and of the cover 10 are continuous with one another.

Figure 8:
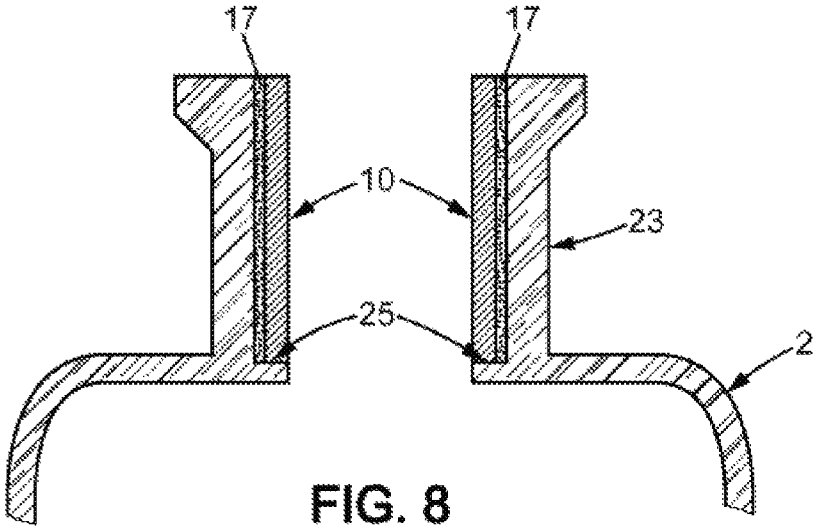
FIG. 8 is a schematic cross-sectional view of a neck of a packaging device, partially represented, according to a sixth embodiment of the invention.

In FIGS. 8 and 10, the cover 10 is fixed in the neck 23 by bonding 17 between the outer surface of the cover and the inner surface of the glass neck 23.

We now describe the method for implementing the examples illustrated in FIGS. 7 to 12: The interior of the neck 23 is structured, meaning it is made so as to create at least one internal shoulder 24 or 25. This interior structure with shoulder 24 and/or 25 is created in the neck mold during the bottle manufacturing process, for example, or by machining etc.

The functional cover 10 is made independently, of a material capable of creating a seal between the product contained in the bottle and the neck 23, so as to protect the bonding by ultraviolet radiation, etc.

The seal 28, 29, or 30 is assembled mechanically in order to ensure fluidtight bonding. It may be overmolded onto or bi-injected with the cover 10 or may be mechanically assembled.

One will note that the bottle and the neck are made of glass in the embodiments described, but the use of other materials remains within the scope of the invention, in particular plastics.

The invention claimed is:

1. A packaging device for a product to be dispensed, comprising:

a bottle suitable for containing the product to be dispensed and having a neck delimiting an opening, a dispensing device comprising a body arranged in the neck and suitable for dispensing said product, said dispensing device being a pump, a cover masking the body of the dispensing device, wherein said cover is located in the neck of said bottle, wherein the neck has an internal shoulder at a free end, wherein the cover has an end forming an elbow suitable for bearing against said internal shoulder of said neck, wherein the neck is formed integrally with the bottle, and wherein a washer-like seal is coaxially positioned at least partially inside the neck, against one end of the cover.

2. The packaging device according to claim 1, wherein the cover is at least partially fixed to an inner wall of the neck.

3. The packaging device according to claim 1, wherein the washer-seal is positioned between the cover and an inner wall of the neck.

4. The packaging device for a product to be dispensed, comprising:

a bottle suitable for containing the product to be dispensed and having a neck delimiting an opening, a dispensing device comprising a body arranged in the neck and suitable for dispensing said product, and a cover masking the body of the dispensing device, wherein said cover is located in the neck of said bottle, wherein the neck is attached to the bottle, said packaging device comprising a second neck formed integrally with said bottle, said dispensing device being at least partially fixed in said second neck and said attached neck surrounding said second neck, and wherein the cover comprises two cylindrical coaxial elements respectively having an internal thread and an external thread, the internal thread and the external thread engaging to enable screwing the two elements together, one of the elements of the cover being fixed around the second neck and the other element of the cover being fixed inside the attached neck.

5. The packaging device according to claim 1, Wherein the cover comprises a material fluidtight to said product.

6. The packaging device according to claim 5, wherein the cover is made of one of tinted plastic, metal-covered plastic, decorated and textured metal.

7. The packaging device according to claim 1, wherein the neck forms an internal shoulder with an upper end of the bottle.

8. The packaging device according to claim 1, wherein the bottle is made of glass.

9. The packaging device according to claim 1, wherein the bottle is made of transparent or translucent material.

10. A method for producing a packaging device for a product to be dispensed, the packaging device comprising:

a bottle suitable for containing the product to be dispensed and having a neck delimiting an opening, a dispensing device comprising a body arranged in the neck and suitable for dispensing said product, said dispensing device being a pump, a cover masking the body of the dispensing device, wherein the cover has an end forming an elbow suitable for bearing against said internal shoulder of said neck, wherein the method comprises:

providing a bottle suitable for containing a product to be dispensed and having a neck delimiting an opening wherein the neck has an internal shoulder at a free end, providing a dispensing device comprising a body and suitable for bearing against the internal shoulder of said neck, fixing said cover in the neck of said bottle so that the elbow of the cover bears against the internal shoulder of the neck, and wherein the cover is fixed to any of the parts of the packaging device by bonding with ultraviolet radiation, hot-melt adhesion, remelting glass, bonding with enamel, by high pulsed power, or bonding two adhesive metallized plates, one of the two plates being previously bonded to the bottle and the other plate being previously bonded to the neck.

11. The method according to claim 10, wherein the neck is attached to the bottle and wherein the attached neck is fixed to the packaging device by bonding with ultraviolet radiation, hot-melt adhesion, remelting glass, bonding with enamel, by high pulsed power, or bonding two adhesive metallized plates, one of the two plates being previously bonded to the bottle and the other plate being previously bonded to the neck.

12. The method according to claim 10, wherein a glass bottle is used.

* * * * *